US007214030B2

(12) United States Patent
Arilla et al.

(10) Patent No.: US 7,214,030 B2
(45) Date of Patent: May 8, 2007

(54) GUIDE SYSTEM FOR THE OUTER PIVOT OF A VARIABLE STATOR VANE, FOR A TURBOJET STATOR

(75) Inventors: Jean-Baptiste Arilla, Lanne en Baretous (FR); Pierre-Yves Maillard, La Chapelle Gauthier (FR); Alain Marc Lucien Bromann, Vulaine sur Seine (FR)

(73) Assignee: Snecma Moteurs, Paris (FR)

( * ) Notice: Subject to any disclaimer, the term of this patent is extended or adjusted under 35 U.S.C. 154(b) by 113 days.

(21) Appl. No.: 10/887,832

(22) Filed: Jul. 12, 2004

(65) Prior Publication Data

US 2005/0036885 A1 Feb. 17, 2005

(30) Foreign Application Priority Data

Jul. 17, 2003 (FR) ..... 03 50343

(51) Int. Cl.
*F01D 17/16* (2006.01)

(52) U.S. Cl. ..... 415/160; 415/229

(58) Field of Classification Search ..... 415/160, 415/229

See application file for complete search history.

(56) References Cited

U.S. PATENT DOCUMENTS

| | | | | |
|---|---|---|---|---|
| 3,325,087 | A | 6/1967 | Davis et al. | |
| 5,308,226 | A * | 5/1994 | Venkatasubbu et al. | 415/160 |
| 6,481,960 | B2 * | 11/2002 | Bowen | 415/160 |
| 6,767,183 | B2 * | 7/2004 | Schilling et al. | 415/160 |

FOREIGN PATENT DOCUMENTS

| | | |
|---|---|---|
| FR | 1 436 413 | 3/1966 |
| FR | 1 459 593 | 10/1966 |
| FR | 1 548 701 | 10/1968 |
| GB | 1 083 156 | 9/1967 |
| GB | 1 201 949 | 8/1970 |

* cited by examiner

*Primary Examiner*—Richard A. Edgar
(74) *Attorney, Agent, or Firm*—Oblon, Spivak, McClelland, Maier & Neustadt, P.C.

(57) ABSTRACT

The system enables an increase in the guidance length of the outer pivot of the vane, so that the bushing can be extracted without needing to open the stator casing. It mainly includes a bushing placed inside a bossing of the stator, the length of which is greater than the length of the bossing projecting outwards from the bossing. Thus, the contact length of the outer pivot is prolonged. The bushing is terminated at its end by a gripping hook to enable extraction of the bushing by means of a claw. It is advantageously also provided with a positioning edge.

14 Claims, 2 Drawing Sheets

PRIOR ART

GUIDE SYSTEM FOR THE OUTER PIVOT OF A VARIABLE STATOR VANE, FOR A TURBOJET STATOR

FIELD OF THE INVENTION

The invention relates to the control of variable stator vanes in turbojets, particularly turbojets for use in aeronautics. It is particularly applicable to the control of air inlet guide vanes in turbojet compressors, called variable stator vanes.

PRIOR ART AND PROBLEM THAT ARISES

Known devices for control of variable stator vanes in turbojets, particularly at the inlet of compressors, normally comprise a control device in the form of a ring surrounding the turbojet casing and several control levers. Each of these control levers has a first end installed on an outer pivot of a vane, for which the axis is the vane pivoting axis vane and a second end connected through an articulation to the control ring. The synchronised modification of the angular position of the vanes is therefore obtained by the ring rotating about the axis of the turbojet, so that it can follow the rotation movement of the control ring. The connection between each lever and the ring comprises at least one degree of freedom in rotation about an axis arranged approximately in the radial direction with respect to the ring.

The rotation movement applied to the vanes is essential to optimize the efficiency of the turbojet and the margin for compression. The precision and hysteresis are very important for modem high-pressure bodies in turbojets. In other words, the attachment of the end of the control lever to the outer pivot of the vane must be very precise.

Figure 1:
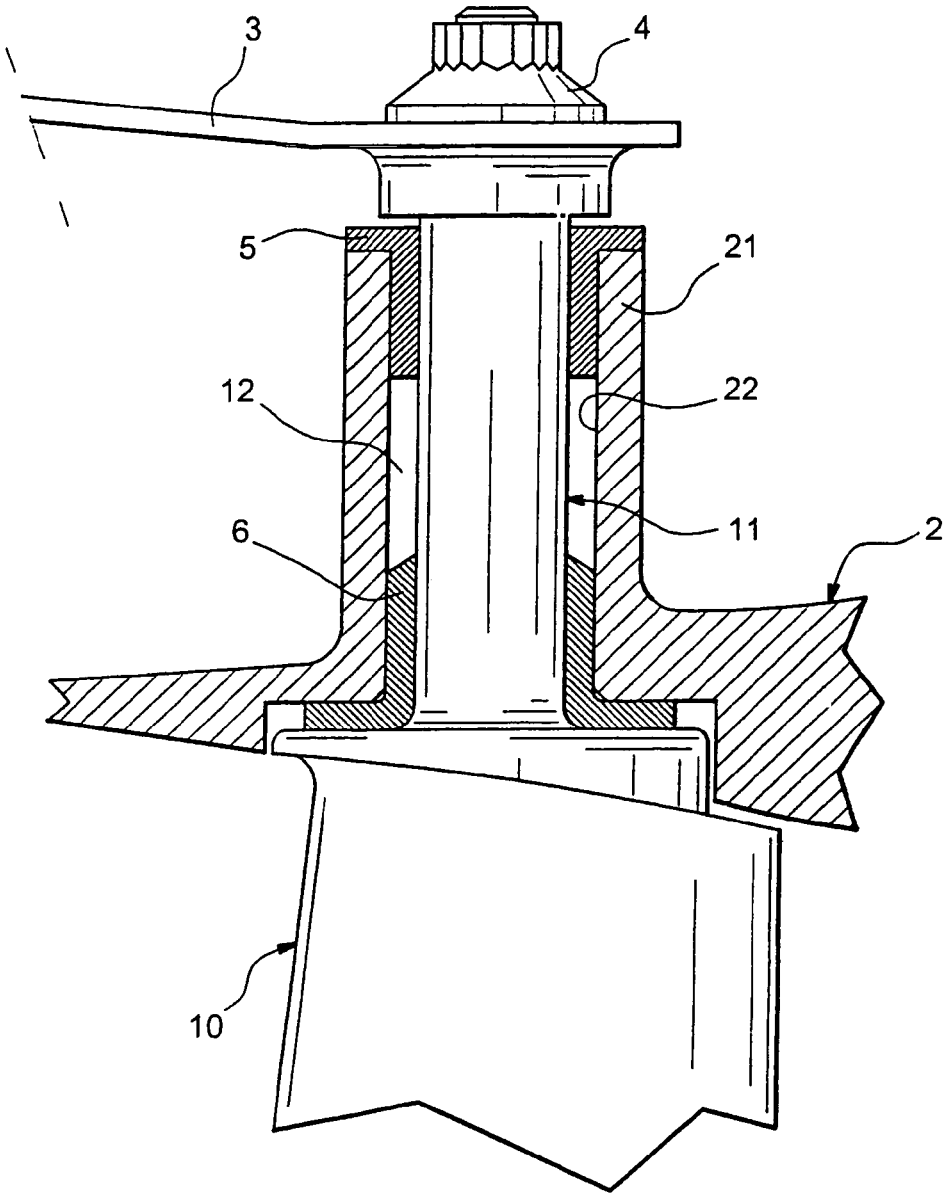

FIG. 1 illustrates the assembly of the outer pivot 11 of a vane 10 on a bossing 21 of the casing 2 of a compressor stator. The outer pivot 11 is installed free to turn in a reaming 22 of the bossing 21 through two bushings 5 and 6 mounted tight or free to slide in the reaming 22. Thus, a control lever 3 fixed on the end of the outer pivot 11 by means of a nut 4 provides a means of orienting the pitch of the vane 10.

It is desirable to be able to reduce the contact pressure between the outer pivot 11 of the vane 10 and the bushings 5 and 6, knowing that a space 12 remains between the two bushings 5 and 6. However, an increase in the guidance height of the outer pivot 11 in the reaming 22 of the bossing 21 would increase the height of the bossing. Such an increase of the height of the bossing 22 obviously requires an increase in the outside diameter of the casing of the stator 2, and therefore a greater increase in the cost of the as-cast casing and the machining to be done on it afterwards.

Therefore, the purpose of the invention is to increase the guidance height of the bushings 5 and 6 without increasing the outside diameter of the casing 2, in order to keep the initial as-cast casing.

SUMMARY OF THE INVENTION

To achieve this, the main purpose of the invention is a guide system for the outer pivot of a variable stator vane for a turbojet stator with an outer pivot designed to pivot in a reaming with a determined length in the turbojet stator casing.

According to the invention, a single bushing is used made of a material with a low coefficient of friction, the length of which is greater than the length of the reaming, projecting outwards from the reaming, and for which the inside diameter is slightly greater than the outside diameter of the outer pivot, comprising a metallic liner for which the outside diameter is slightly greater than the inside diameter of the reaming and for which the inside diameter corresponds to the outside diameter of the bushing so that it is placed around the bushing, and it has an external hook at its outer end.

In the preferred embodiment of the invention, the bushing is metallic and a peripheral outer hook is provided at the outer end of the metallic liner, so as to be able to form a gripping element to extract the bushing.

It is also advantageous if the metallic liner is provided with a positioning edge to bear on the bushing of the stator casing.

LIST OF FIGURES

Figure 2:
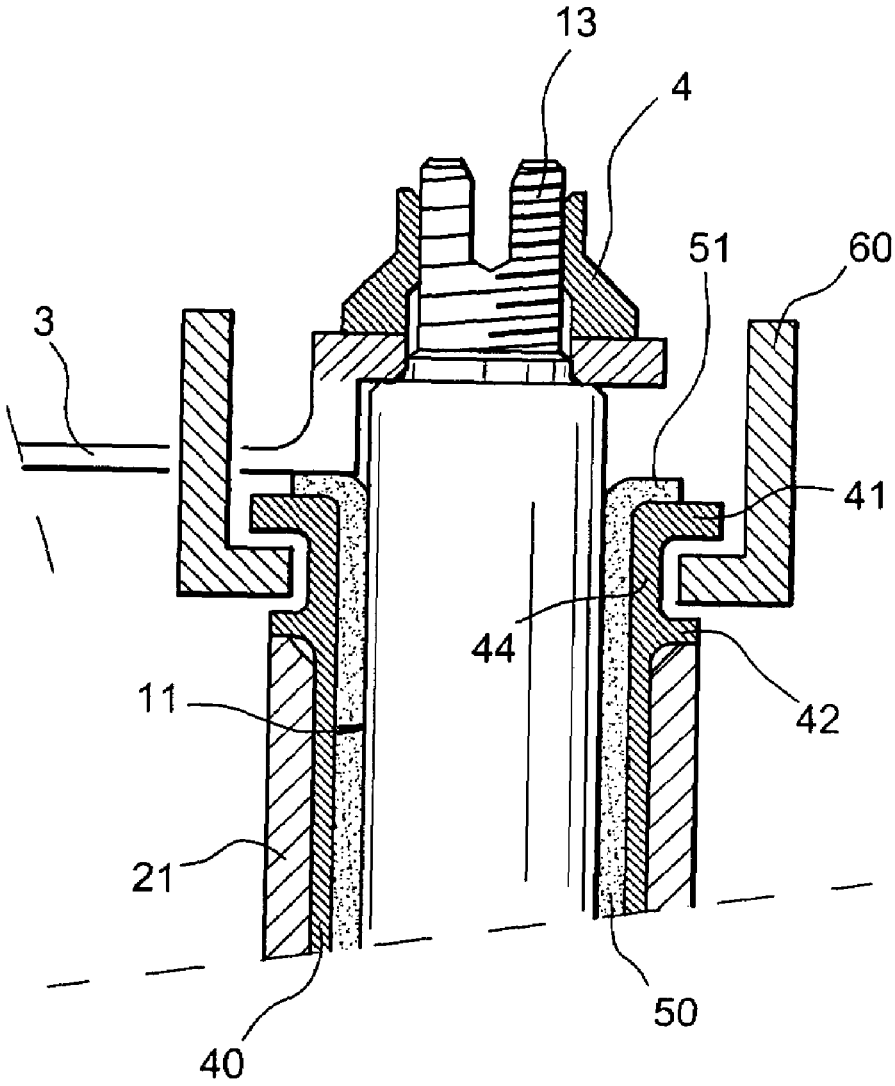

The invention and its various technical characteristics will be better understood after reading the following description with reference to the two figures:

FIG. 1 shows a sectional view of a guide assembly according to prior art, and FIG. 2 shows a sectional view of the main embodiment of the guide system according to the invention.

DETAILED DESCRIPTION OF TWO EMBODIMENTS OF THE INVENTION

FIG. 2 shows the outer pivot 11 of a vane, or at least its end part and the bossing 21 of the stator casing of the turbojet. The end of the outer pivot 11 is provided with a thread 13 on which a nut 4 is screwed. This nut tightens the drive end of the lever 3 that will pivot the vane.

The outer pivot 11 is positioned in the reaming of the bossing 21 by means of a bushing 50 that extends over more than the length of the bossing 21 and for which the inside diameter is slightly greater than the outside diameter of the outer pivot 11.

The bushing 50 is made of a composite material and it is always in direct contact through its inside diameter with the outside diameter of the outer pivot 11. Due to the composite material from which it is made, the coefficient of friction in contact with another metallic part is very low, facilitating relative displacement between these two parts. A metallic liner 40 is inserted between the bushing 50 and the bossing 21 of the stator. This metallic liner 40 has an outside diameter slightly greater than the inside diameter of the reaming of the bossing 21 to enable attachment by banding. Moreover, it is provided with an outer hook 41 at its outer end 44 that is completed by a positioning edge 42 bearing on the bossing 21 of the stator. Relative sliding takes place firstly between the bushing 50 made of a composite material and the outer pivot 11 of the vane, and secondly between the bushing 50 made of a composite material and the metallic liner 44. This system enables extraction of the bushing 50 made of a composite material and the metallic liner 44, without disassembling the vane, by means of a claw 60 that is engaged under the hook 41. Furthermore, if the bushing 50 made of a composite material degrades, the bossing 21 of the casing is protected by the metallic liner.

Note that the bushing 50 has an outer hook 51 that the bushing used to entrain it during its extraction. This outer hook 51 bears on the outer hook 41 of the metallic liner 40.

Thus, it can be understood that the length of the contact surface of the outer pivot 11 is prolonged beyond the bossing 21.

The bushing 50 can be extracted to replace it without needing to open the turbojet stator casing.

Moreover, this type of assembly provides better guidance of the outer pivot 11 without increasing the casing diameter.

In this first embodiment, the bushing is metallic, and in particular it is composed of a steel with good friction characteristics with the material used for the pivot, for example a bushing made of Z12CNDV12 with a pivot made of Z6NCT25.

The invention claimed is:

1. A guide system for the outer pivot of a variable stator vane for a turbojet stator having an outer pivot of a vane intended to pivot in a reaming with a determined length in a turbojet stator casing, comprising:

a single bushing made from a material with a low coefficient of friction, for which a length is greater than a length of the reaming, projecting outwards from the reaming and for which an inside diameter is slightly greater than an outside diameter of the outer pivot; and a metallic liner for which an outside diameter is slightly greater than an inside diameter of the reaming and for which an inside diameter corresponds to an outside diameter of the bushing, so that the liner is placed around the bushing, and is provided with an outer hook at an outer end of the liner extending away from an upper edge of a bossing of the stator casing and configured to receive a claw, wherein the metallic liner has a positioning edge bearing on the bossing of the stator casing.

2. The guide system according to claim 1, wherein the bushing is metallic and is provided with a peripheral outer hook at the outer end of the metallic liner.

3. The guide system according to claim 1, wherein the bushing is made of a composite material.

4. The guide system according to claim 1, wherein the hook of the liner extends above the positioning edge of the liner.

5. The guide system according to claim 4, wherein the liner is configured to receive the claw in a space between the hook of the liner and the positioning edge of the liner.

6. A compressor including the guide system of claim 1.

7. A turbojet including the guide system of claim 1.

8. A guide system comprising:

an outer pivot of a variable stator vane, the outer pivot located in a reaming of a turbojet stator casing;

a single bushing made from a material with a low coefficient of friction, the bushing having a length greater than a length of the reaming and projecting outwards from the reaming, the bushing having an inside diameter slightly greater than an outside diameter of the outer pivot; and a metallic liner with an outside diameter slightly greater than an inside diameter of the reaming and an inside diameter corresponding to an outside diameter of the bushing, the liner being placed around the bushing, and the liner including an outer hook at an outer end of the liner extending away from an upper edge of a bossing of the stator casing and configured to receive a claws, wherein the metallic liner has a Positioning edge bearing on the bossing of the stator casing.

9. The guide system according to claim 8, wherein the bushing is metallic and includes a peripheral outer hook at the outer end of the metallic liner.

10. The guide system according to claim 8, wherein the bushing is made of a composite material.

11. The guide system according to claim 8, wherein the hook of the liner extends above the positioning edge of the liner.

12. The guide system according to claim 11, wherein the liner is configured to receive the claw in a space between the hook of the liner and the positioning edge of the liner.

13. A compressor including the guide system of claim 8.

14. A turbojet including the guide system of claim 8.

* * * * *

UNITED STATES PATENT AND TRADEMARK OFFICE

CERTIFICATE OF CORRECTION

PATENT NO. : 7,214,030 B2
APPLICATION NO. : 10/887832
DATED : May 8, 2007
INVENTOR(S) : Jean-Baptiste Arilla et al.

It is certified that error appears in the above-identified patent and that said Letters Patent is hereby corrected as shown below:

Column 2, line 50, delete “41” and insert --40--.

Column 4, line 21, delete “claws” and insert --claw--.

Signed and Sealed this

Fourteenth Day of August, 2007

JON W. DUDAS
*Director of the United States Patent and Trademark Office*